US009015938B2

(12) United States Patent
Barnett et al.

(10) Patent No.: US 9,015,938 B2
(45) Date of Patent: Apr. 28, 2015

(54) METHOD OF FABRICATING A CRUSHABLE CONNECTOR INTERFACE

(71) Applicant: National Instruments Corporation, Austin, TX (US)

(72) Inventors: Ron J. Barnett, Santa Rosa, CA (US); Gregory S. Gonzales, Sebastopol, CA (US)

(73) Assignee: National Instruments Corporation, Austin, TX (US)

( * ) Notice: Subject to any disclaimer, the term of this patent is extended or adjusted under 35 U.S.C. 154(b) by 0 days.

(21) Appl. No.: 14/073,084

(22) Filed: Nov. 6, 2013

(65) Prior Publication Data

US 2014/0059854 A1 Mar. 6, 2014

Related U.S. Application Data

(62) Division of application No. 13/043,592, filed on Mar. 9, 2011, now Pat. No. 8,530,758.

(60) Provisional application No. 61/369,534, filed on Jul. 30, 2010.

(51) Int. Cl.

| | |
|---|---|
| ***H01R 43/04*** | (2006.01) |
| ***H01P 1/203*** | (2006.01) |
| ***H01R 13/24*** | (2006.01) |
| ***H01R 43/26*** | (2006.01) |
| ***H01R 43/16*** | (2006.01) |
| *H01R 31/06* | (2006.01) |
| *H01P 1/22* | (2006.01) |

(52) U.S. Cl.

CPC ..... *H01P 1/203* (2013.01); *H01R 13/2407* (2013.01); *H01R 31/06* (2013.01); *H01R 43/26* (2013.01); *H01R 43/16* (2013.01); *H01P 1/227* (2013.01)

(58) Field of Classification Search

CPC .. H01R 12/592; H01R 13/24; H01R 13/5219; H01R 13/6584; H01R 24/40; H01R 9/0503; H01R 13/65802; H01R 13/512; H01R 13/622; H01R 23/688; H01R 9/05; H01R 13/2414; H01R 13/658

USPC ..... 29/882, 857, 867, 874; 439/273, 279, 439/281, 320, 321, 352, 489, 579

See application file for complete search history.

(56) References Cited

U.S. PATENT DOCUMENTS

| | | | | |
|---|---|---|---|---|
| 3,596,231 | A | 7/1971 | Melton | |
| 3,622,939 | A | 11/1971 | Forney, Jr. | |
| 3,786,396 | A * | 1/1974 | Kemmer et al. | 439/321 |
| 4,342,496 | A | 8/1982 | Hutter et al. | |

(Continued)

*Primary Examiner* — Thiem Phan

(74) *Attorney, Agent, or Firm* — Meyertons Hood Kivlin Kowert & Goetzel, P.C.; Jeffrey C. Hood; Stephen A. Mason

(57) ABSTRACT

A connector is disclosed. The connector includes a conductive housing. The conductive housing includes a wall region enclosing a space for receiving an adapter. The conductive housing also includes an annular end piece extending radially inward from a first end of the wall region and terminating the space. The annular end piece includes a flat annular surface, and a raised deformable annulus mounted on the flat annular surface. The raised deformable annulus is of a height such that an insertion of the adapter into the space deforms the raised deformable annulus to generate a physical contact connection between the flat annular surface and the adapter.

8 Claims, 9 Drawing Sheets

(56) References Cited

U.S. PATENT DOCUMENTS 4,521,064 A 6/1985 Knapp et al.
5,277,619 A 1/1994 Yamamoto
5,960,537 A 10/1999 Vicich et al.
6,080,002 A 6/2000 Macleod et al.

* cited by examiner

METHOD OF FABRICATING A CRUSHABLE CONNECTOR INTERFACE

CLAIM OF PRIORITY

This application claims priority as a divisional of U.S. application Ser. No. 13/043,592, entitled "CRUSHABLE CONNECTOR INTERFACE," filed Mar. 9, 2011, which claims benefit of priority of U.S. Provisional Patent Application No. 61/369,534 filed on Jul. 30, 2010, both of which are hereby incorporated by reference in their entirety as though fully and completely set forth herein and relied on for claim of priority.

FIELD OF THE INVENTION

The present invention relates to the field of measurement and data acquisition systems, and more particularly to a method and apparatus for providing a crushable connector interface.

DESCRIPTION OF THE RELATED ART

Scientists and engineers often use measurement systems to perform a variety of functions, including measurement of physical phenomena or behavior of a unit under test (UUT), test and analysis of physical phenomena, process monitoring and control, control of mechanical or electrical machinery, data logging, laboratory research, and analytical chemistry, to name a few examples.

A typical measurement system comprises a computer system with a measurement device or measurement hardware. The measurement device may be a computer-based instrument, a data acquisition device or board, a programmable logic device (PLD), an actuator, or other type of device for acquiring or generating data. The measurement device may be a card or board plugged into one of the I/O slots of the computer system, or a card or board plugged into a chassis, or an external device. For example, in a common measurement system configuration, the measurement hardware is coupled to the computer system through a PCI bus, PXI (PCI extensions for Instrumentation) bus, a GPIB (General-Purpose Interface Bus), a VXI (VME extensions for Instrumentation) bus, a serial port, parallel port, or Ethernet port of the computer system. The measurement system can be connected to a data source, which communicates with the measurement system using radio-frequency and microwave electrical connections.

Since its development in the 1960s, the SubMiniature version A (SMA) connector and its descendants have been used to provide radio frequency (RF) and microwave electrical connections, often with intervening cabling, between electrical devices of many types. While other geometries and material choices are available, basic SMA connector designs use a 4.2 millimeter diameter outer conductor, filled with Polytetrafluoroethylen (PTFE) dielectric. SMA-type connectors are frequently used as components of a connection between a measurement system and a data source to transmit signals including measurements.

SUMMARY OF THE INVENTION

A connector is disclosed. The connector includes a conductive housing. The conductive housing includes a wall region enclosing a space for receiving an adapter. The conductive housing also includes an annular end piece extending radially inward from a first end of the wall region and terminating the space. The annular end piece includes a flat annular surface, and a raised deformable annulus mounted on the flat annular surface. The raised deformable annulus is of a height such that an insertion of the adapter into the space deforms the raised deformable annulus to generate a physical contact connection between the flat annular surface and the adapter.

BRIEF DESCRIPTION OF THE DRAWINGS

A better understanding of the present invention can be obtained when the following detailed description of the preferred embodiment is considered in conjunction with the following drawings, in which.

Figure 1:
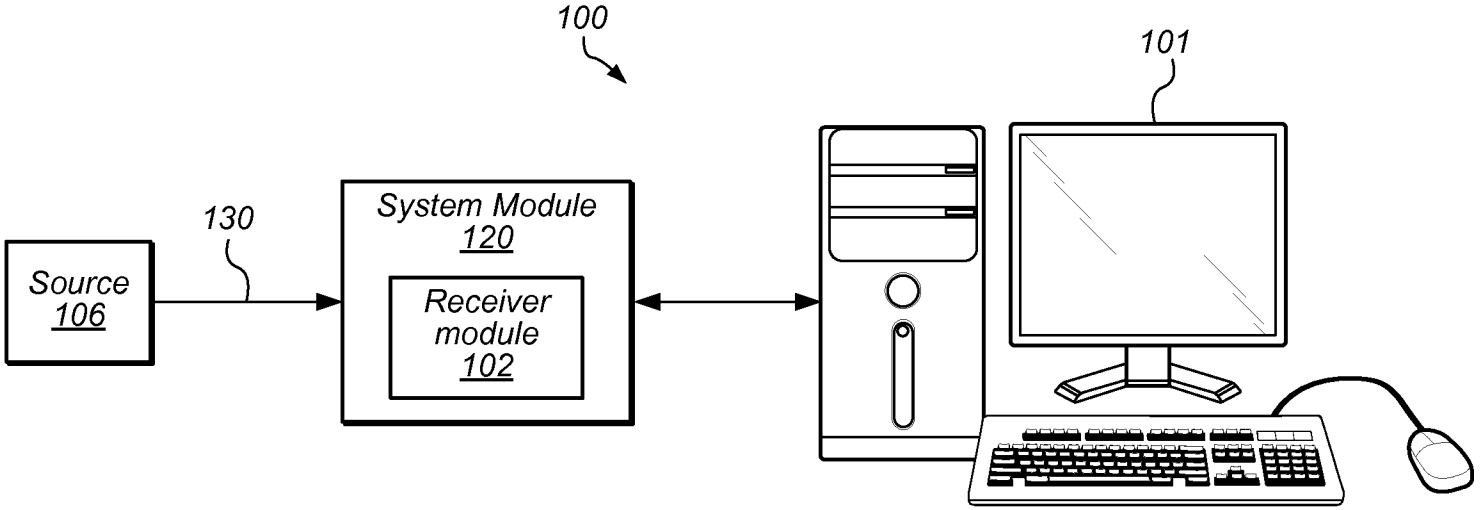
FIG. 1 illustrates a computer system configured to perform data acquisition functions compatible for use with an embodiment of the present invention.

While the invention is susceptible to various modifications and alternative forms, specific embodiments thereof are shown by way of example in the drawings and are herein described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DETAILED DESCRIPTION OF THE INVENTION

Introduction to Crushable Connector Interfaces

In one embodiment, a system for acquiring data connects to a data source using a connector with a conductive housing. In some embodiments, the connector receives an adapter for connecting a receiver module to a cable for carrying a signal. The signal may include measurement data. The conductive housing may include a threaded interior wall region. In some embodiments, the threaded interior wall region is used to affix the adapter into the connector by means of contact between the threaded interior wall region and complementary threads of the adapter. An annular end piece extends radially inward from a first end of the threaded wall region and terminates the space enclosed by the threaded interior wall region. In some embodiments, the center hole of the annular end piece is occupied by a dielectric tube housing a central conductive pin and isolating the central conductive pin from the annular endpiece.

The annular end piece includes a flat annular surface and a raised deformable annulus mounted on the flat annular surface. The raised deformable annulus is of a height such that an insertion of the adapter into the connector deforms the raised deformable annulus to generate a physical contact connection between the flat annular surface and the adapter. In some embodiments, twisting or screwing the adapter into the connector generates a torque that is translated into a force that compresses or crushes the raised deformable annulus to generate the physical contact connection between the annular endpiece and the adapter. In some embodiments, the raised deformable annulus takes the form of a deformable annular ring. In some embodiments, the deformable annulus is composed of a material of yield strength lower than the yield strength of the flat annular surface (i.e., the annular endpiece). In alternative embodiments, the raised deformable annulus and the annular endpiece may be composed of the same material. In some embodiments, radio-frequency or microwave signals are transmitted across the physical contact connection. The signal transmitted across the physical contact connection may be a ground connection as part of a coaxial transmission link for transmitting measurement data.

In some embodiments, a coaxial RF interface (i.e., the adapter) has an outer conductor that completely radially surrounds a center conductor. The outer conductor contacts the threaded interior wall and annular end piece of the connector, referred to collectively herein as the ground interface. The inner conductor contacts the central pin of the connector referred to herein as the signal interface.

In some embodiments, the ground interface includes a conductive circular ring formed by the raised deformable annulus as described below. The circular ring may be raised relative to a flat annular surface of the ground interface. Because the circular ring is raised relative to the flat annular surface, the mating surface of the complementary RF adapter or connector will make contact with the circular ring instead of the flat annular surface. Furthermore, because the area of the circular ring is much smaller than the area of the flat annular surface, the pressures created on the circular ring by the ordinary force of coupling (threading) the RF adapter into the connector are, in some embodiments, much greater than the pressure that would be obtained if the circular ring were not present and the mating surface of the complementary connector were to make contact on the flat annular surface.

FIG. 1: Data Acquisition System

FIG. 1 is a diagram of one embodiment of a computer-based measurement system or data acquisition system 100. The data acquisition system 100 may comprise a computer system 101, which may be coupled to a measurement device, such as a radio receiver, referred to as radio frequency (RF) receiver module 102, through a communication medium 130 using a connector as described below. RF receiver module 102 may be an internal card or board coupled to a bus, e.g., a Peripheral Component Interconnect (PCI), PCI Express, Industry Standard Architecture (ISA), or Extended Industry Standard Architecture (EISA) bus, but is shown external to the computer 101 for illustrative purposes. RF receiver module 102 may also be an external device coupled to the computer system 101. In this embodiment, the communication medium 130 may be a serial bus, such as USB, IEEE 1394, MXI bus, Ethernet, or a proprietary bus, or a parallel bus such as GPIB or others. It is noted that the communication medium 130 may be a wired or wireless communication medium.

RF receiver module 102 may be integrated into a system module 120 coupled, using the connector described below, to an external source 106, such as an instrument, antenna, sensor, transducer, or actuator from which RF receiver module 102 may receive an input signal, e.g., an analog input such as sensor data. In one example, the external source 106 may be a radio frequency sensor, which is comprised in a unit under test (UUT). In this example, RF receiver module 102 may receive radio frequency analog signal reading data from the radio frequency sensor and convert the analog data to digital form to be sent to the computer system 101 for analysis. Additionally, RF receiver module 102 may receive a digital input, e.g., a binary pattern, from the external source 106 (e.g., a UUT). Furthermore, the RF receiver module 102 may also produce analog or digital signals, e.g., for stimulating the UUT.

Computer system 101 may be operable to control RF receiver module 102. For example, computer system 101 may be operable to direct RF receiver module 102 to perform an acquisition, and may obtain data from RF receiver module 102 for storage and analysis therein. Additionally, the computer system 101 may be configured to send data to RF receiver module 102 for various purposes, such as for use in generating analog signals used for stimulating a UUT.

The computer system 101 may include a processor, which may be any of various types, including an x86 processor, e.g., a Pentium™ class, a PowerPC™ processor, a CPU from the SPARC™ family of RISC processors, as well as others. Also, the computer system 101 may also include one or more memory subsystems (e.g., Dynamic Random Access Memory (DRAM) devices). The memory subsystems may collectively form the main memory of computer system 101 from which programs primarily execute. The main memory may be operable to store a user application and a driver software program. The user application may be executable by the processor to conduct the data acquisition/generation process. The driver software program may be executable by the processor to receive data acquisition/generation tasks from the user application and program RF receiver module 102 accordingly.

Exemplary Systems

Embodiments of the present invention may be involved with performing test and/or measurement functions and controlling and/or modeling instrumentation or industrial automation hardware. However, it is noted that embodiments of the present invention can be used for a plethora of applications and are not limited to the above applications. In other words, applications discussed in the present description are only examples, and embodiments of the present invention may be used in any of various types of systems. Thus, embodiments of the system and method of the present invention are configured to be used in any of various types of applications, including the operation and control of other types of devices such as multimedia devices, video devices, audio devices, telephony devices, Internet devices, radio frequency communication devices, etc.

Figure 2:
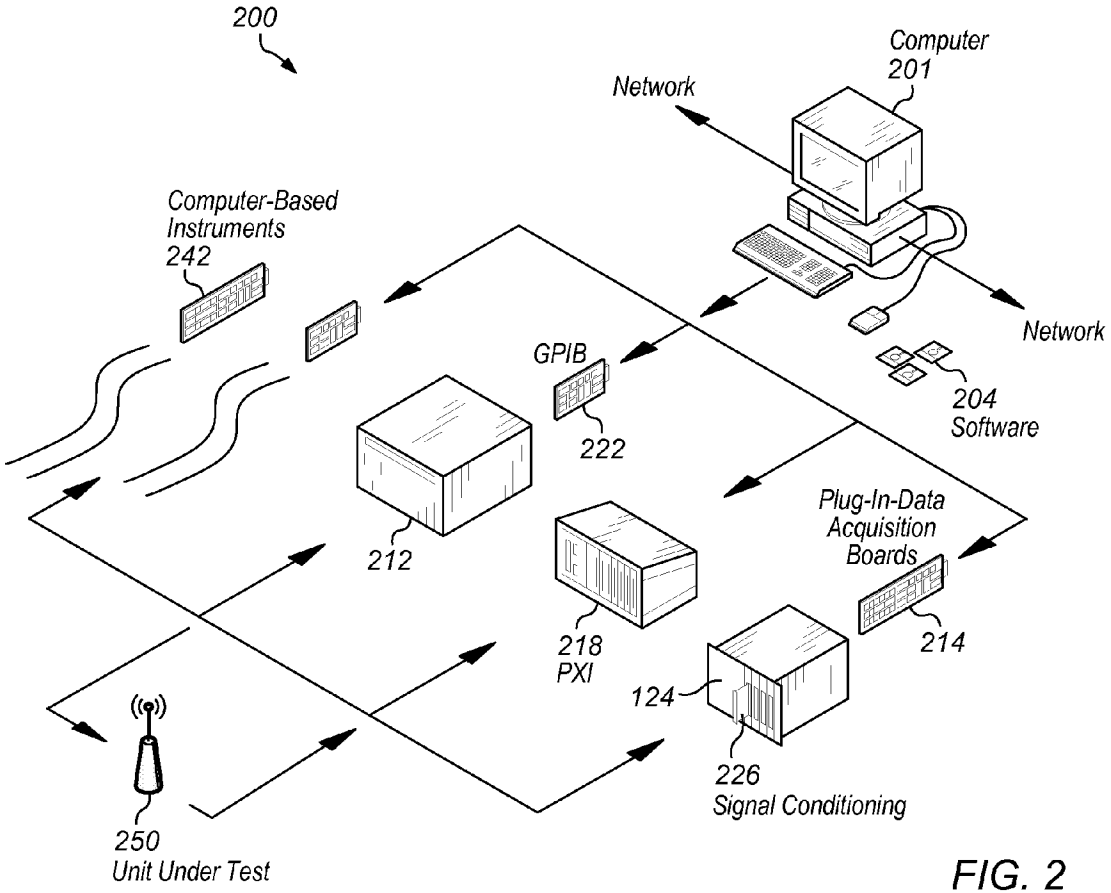
FIG. 2 depicts an instrumentation control system compatible for use with one embodiment of the invention.

FIG. 2 illustrates an exemplary instrumentation control system 200 which may implement embodiments of the invention. The system 200 comprises a host computer 201 which couples to one or more instruments. The host computer 201 may comprise a CPU, a display screen, memory, and one or more input devices such as a mouse or keyboard as shown. The computer 201 may operate with the one or more instruments to analyze, measure or control a unit under test (UUT) 250 or other process (not shown).

The one or more instruments may include a GPIB instrument 212 and associated GPIB interface card 222, a data acquisition board 214 inserted into or otherwise coupled with chassis 224 with associated signal conditioning circuitry 226, a PXI instrument 218, and/or one or more computer based instrument cards 242, among other types of devices. The computer system may couple to and operate with one or more of these instruments. The instruments may be coupled to the unit under test (UUT) 250 or other process, or may be coupled to receive field signals, typically generated by transducers. Prior to transmission of data to computer 201, such field signals may be processed using a filter. The system 200 may be used in a data acquisition and control application, in a test and measurement application, an image processing or machine vision application, a process control application, a man-machine interface application, a simulation application, or a hardware-in-the-loop validation application, among others.

Figure 3:
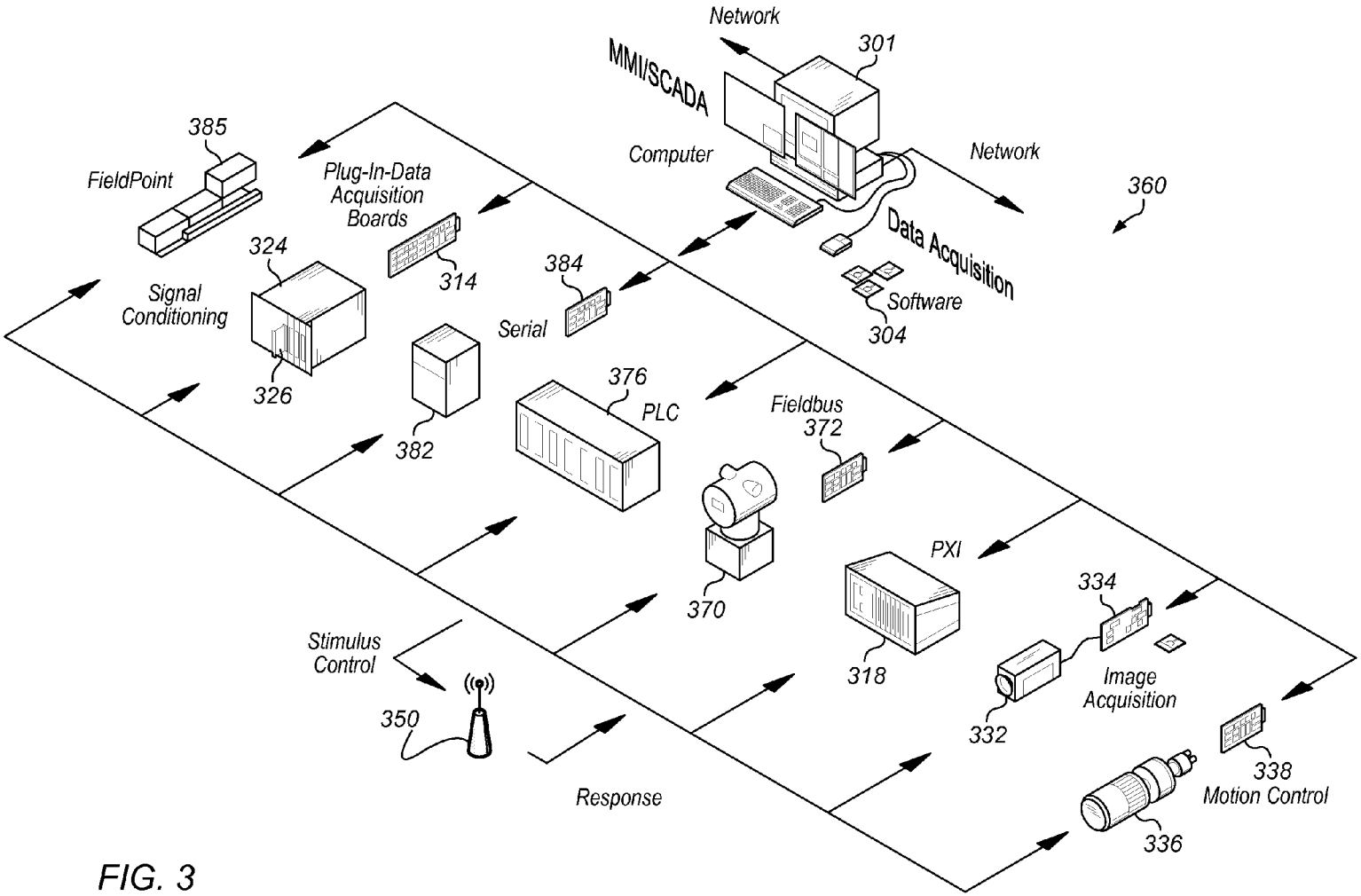
FIG. 3 illustrates an industrial automation system compatible for use with one embodiment of the invention.

FIG. 3 illustrates an exemplary industrial automation system 360 which may implement embodiments of the invention. The industrial automation system 360 is similar to the instrumentation or test and measurement system 200 shown in FIG. 2. The system 360 may comprise a computer 301 which couples to one or more devices or instruments. The computer 301 may comprise a CPU, a display screen, memory, and one or more input devices such as a mouse or keyboard as shown. The computer 301 may operate with the one or more devices to perform an automation function with respect to an RF process or device 350, such as MMI (Man Machine Interface), SCADA (Supervisory Control and Data Acquisition), portable or distributed data acquisition, process control, advanced analysis, or other control, among others.

The one or more devices may include a data acquisition board 314 inserted into or otherwise coupled with chassis 324 with associated signal conditioning circuitry 326, a PXI instrument 318, a video device 332 and associated image acquisition card 334, a motion control device 336 and associated motion control interface card 338, a fieldbus device 370 and associated fieldbus interface card 372, a PLC (Programmable Logic Controller) 376, a serial instrument 382 and associated serial interface card 384, or a distributed data acquisition system, such as the Fieldpoint system available from National Instruments, among other types of devices. The computer system may couple to and operate with one or more of these devices. The instruments may be coupled to the RF process or device 350, or may be coupled to receive field signals, typically generated by transducers. Prior to transmission of data to computer 301, such field signals may be processed using a filter apparatus.

Figure 4:
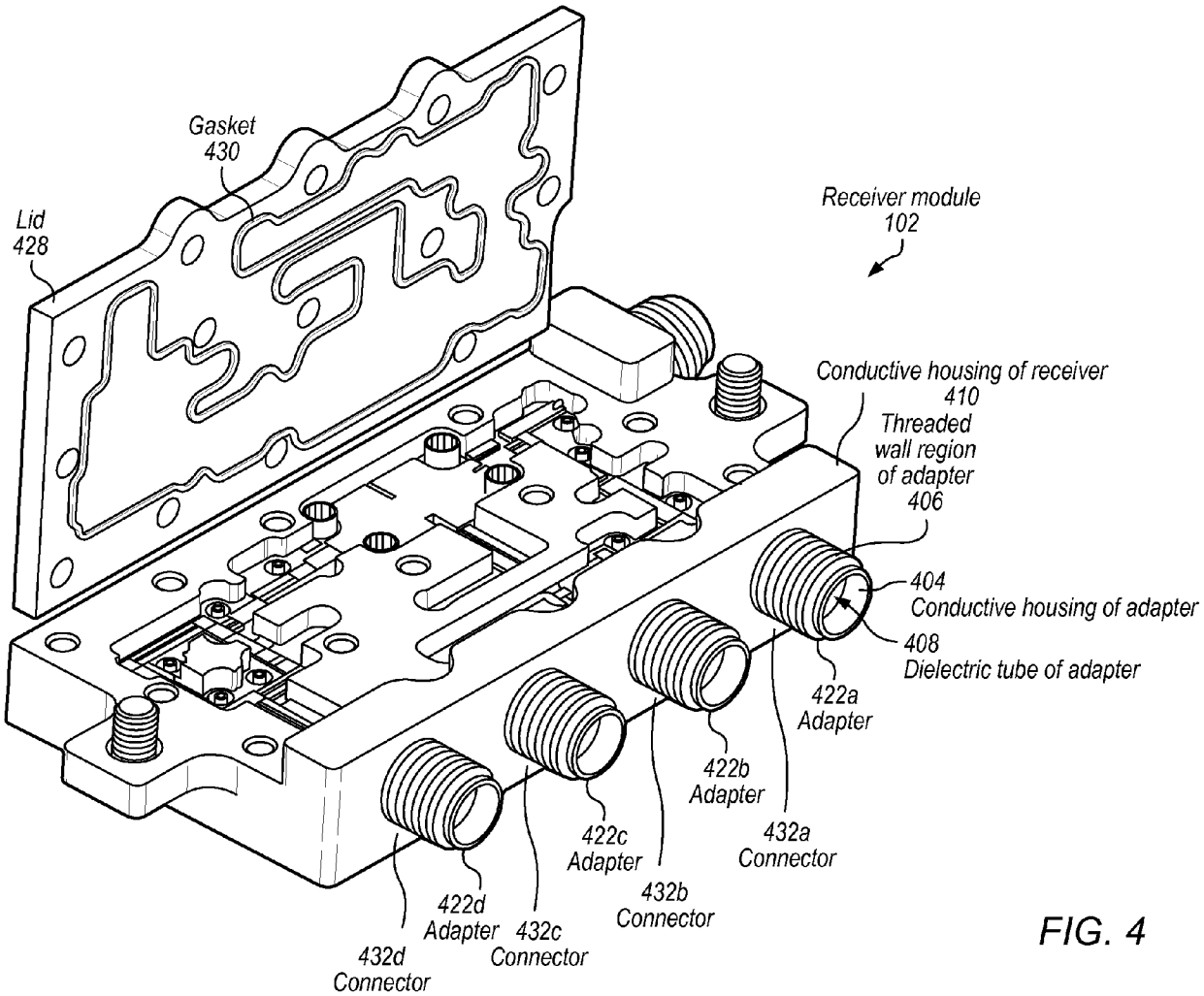
FIG. 4 depicts a receiver module including a connector according to one embodiment of the present invention.

FIG. 4 depicts a receiver module including a connector according to one embodiment of the present invention. Receiver module 102 is designed to receive a circuit (not shown) into a receiver housing 410 with a lid 428 and gasket 430 and allow the circuit to communicate with devices outside the receiver housing by means of connectors 432*a-d* connected to adapters 422*a-d*. In some embodiments, adapters 422*a-d* will attach to cables (not shown) terminated in SMA couplings. Each of adapters 422*a-d* includes a conductive housing, such as conductive housing of adapter 404 with a threaded wall region, such as threaded wall region of adapter 406. Threaded wall region of adapter 406 provides a screw-in interface for affixing adapter 422*a* to connector 432*a* of receiver module 102. Each of connectors 422*a-d* includes a dielectric tube, such as dielectric tube of adapter 408. Composition of dielectric tube of adapter 408 will vary widely between embodiments and will be selected for the electrical and physical characteristics needed in a particular embodiment. In some embodiments, dielectric tube of adapter 408 may be composed of a solid material such as polytetrafluoroethylene (PTFE). In practice, many embodiments use dielectric materials that are solid. Examples include porcelain (ceramic), mica, glass, plastics, and the oxides of various metals. Some liquids and gases can also serve as dielectric materials. Dry air can be used as a dielectric, in some embodiments. In some embodiments, dielectric tube 408 may simply be a hollow space that is allowed to fill with air or an evacuated space.

Figure 5:
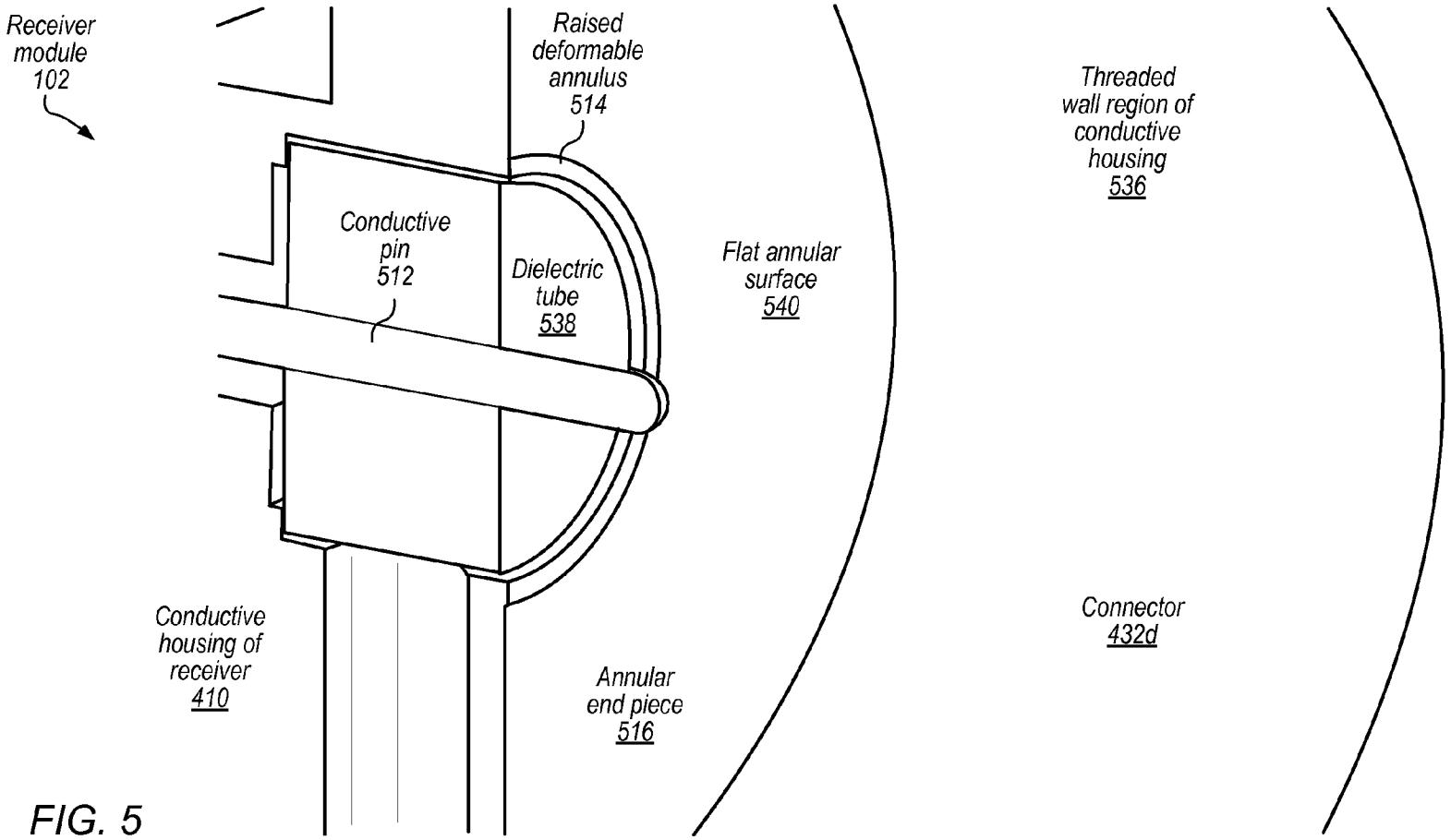
FIG. 5 depicts a connector with a crushable connector interface according to one embodiment of the present invention.

FIG. 5 depicts a connector with a crushable connector interface according to one embodiment of the present invention. Conductive housing of receiver 410 on receiver module 102 includes a threaded wall region of conductive housing 536 as a part of connector 432*d*. A conductive pin 512 is provided for contacting an inner conductor of an adapter (not shown), such as adapter 422*d* of FIG. 4. In one embodiment, conductive housing of receiver 410 and conductive pin 512 will be composed of a highly conductive material or composite of materials, such as gold, copper or alloys of either or both metals. Conductor choices will vary between embodiments. A dielectric tube 538 is radially surrounded by and in some embodiments affixed to an annular end piece 516 extending radially inward from an end of threaded wall region of conductive housing 536. In some embodiments, dielectric tube 538 may be composed of a solid material such as polytetrafluoroethylene (PTFE). In practice, many embodiments use dielectric materials that are solid. Examples include porcelain (ceramic), mica, glass, plastics, and the oxides of various metals.

A raised deformable annulus 514 sits on a flat annular surface 540 of annular end piece 516. Annular end piece 516 terminates a space enclosed by threaded wall region of conductive housing 536 for receiving an adapter. In some embodiments, raised deformable annulus 514, annular end piece 516 and threaded wall region of conductive housing 536 will be composed of a single continuous piece of metal. Thus, creation of flat annular surface 540 and raised deformable annulus 514 is achieved by shaping, for example, using a drill press, conductive housing of receiver 410. Alternatively, raised deformable annulus 514, annular end piece 516 and threaded wall region of conductive housing 536 may be fabricated by casting them as a single piece or may be milled from a block of a solid material. Likewise, raised deformable annulus 514 may be fabricated by depositing metal onto flat annular surface 540. One skilled in the art will, in light of having read the present disclosure, realize that many methods for fabricating raised deformable annulus 514, flat annular surface 540, annular end piece 516 and threaded wall region of conductive housing 536 exist and fall within the scope and intent of the present disclosure.

Raised deformable annulus 514 provides a contact interface for an adapter. In one embodiment, raised deformable annulus 514 is composed of a metal or a composite of metals and the contact interface is designed to undergo crushing (e.g., undergo plastic deformation) when the adapter is mated with (screwed into) connector 432*d*. Raised deformable annulus 514 is composed of material of a yield strength lower than a pressure induced on raised deformable annulus 514 by a torque used to completely insert the adapter into connector 432*d*. For example, the metal is selected so that its yield strength is smaller than the pressure induced by the ordinary force of coupling the connector 432*d* and the adapter on the circular ring presented by raised deformable annulus 514. In some embodiments, threaded wall region of conductive housing 536 is designed such that a precisely measured and applied torque to the adapter will produce a calculated force on raised deformable annulus 514 to deform raised deformable annulus 514 within expected specifications.

In some embodiments, the action of crushing increases the likelihood of a larger area of contact between the contact interface created from raised deformable annulus 514 and a conductive mating surface of the complementary connector, as compared to an interface that is not crushable. In example embodiments providing an RF connector, the larger area of contact may facilitate an improved impedance match and a reduced contact resistance between connector 432*d* and a complementary connector, and thus, less reflection of RF signals at the contact interface. Impedance describes a measure of opposition to alternating currents (AC) such as radio-frequency electrical signals. Electrical impedance extends the concept of resistance to AC circuits, describing not only the relative amplitudes of the voltage and current, but also the relative phases. Improvements in impedance match tend to improve signal transmission efficiency. One skilled in the art will, in light of having read the present disclosure, realize that, in some embodiments, the connector may be an RF connector. In some embodiments, the contact interface is used to receive an adapter that is part of a coaxial connector interface such as in an SMA thread-in connector interface shown in FIG. 4. Coaxial connectors are electrical connectors with an inner conductor surrounded by a tubular insulating layer, surrounded by a tubular conducting shield. The term coaxial comes from the inner conductor and the outer shield sharing the same geometric axis. However, a wide variety of other embodiments are contemplated and are within the scope and intent of the present disclosure.

The crushing of raised deformable annulus 514 also increases the likelihood that the surface of physical contact between raised deformable annulus 514 and the mating surface of the complementary connector will be much more uniform than if raised deformable annulus 514 were not present and the mating surface of the complementary connector were to interface with flat annular surface 540 of annular end piece 516. For example, in some embodiments, the surface of physical contact is likely to extend continuously for the 360 degrees around the circular ring of raised deformable annulus 514. In some embodiments, the crushable contact interface of raised deformable annulus 514 creates a complete 360-degree continuous seal at the ground interface, thereby reducing or eliminating ground current redistribution at the ground interface so that transmission line impedance is not interrupted. Additionally, in some embodiments, such a 360 seal reduces RF leakage by eliminating gaps in the ground interface.

Designs in which raised deformable annulus 514 or a similar circular crushable ring is not present tend to result in a mating surface of the RF connector contacting with the flat annular surface of the annular ring. Because the annular ring is not crushable, the surface of contact generated between the annular ring and the mating surface upon coupling of the RF connector to the port is concentrated in a few points over a limited area. The limited number of contact points forces a redistribution of current to points that are not necessarily located near the boundary with the dielectric material. Thus, the current that flows along the outer conductor of a RF cable (that is coupled to the RF connector) must flow through these few points of contact and is redistributed. Such a connection without raised deformable annulus 514 tends to exhibit greater inductance and resistance than a connection through raised deformable annulus 514.

Figure 6:
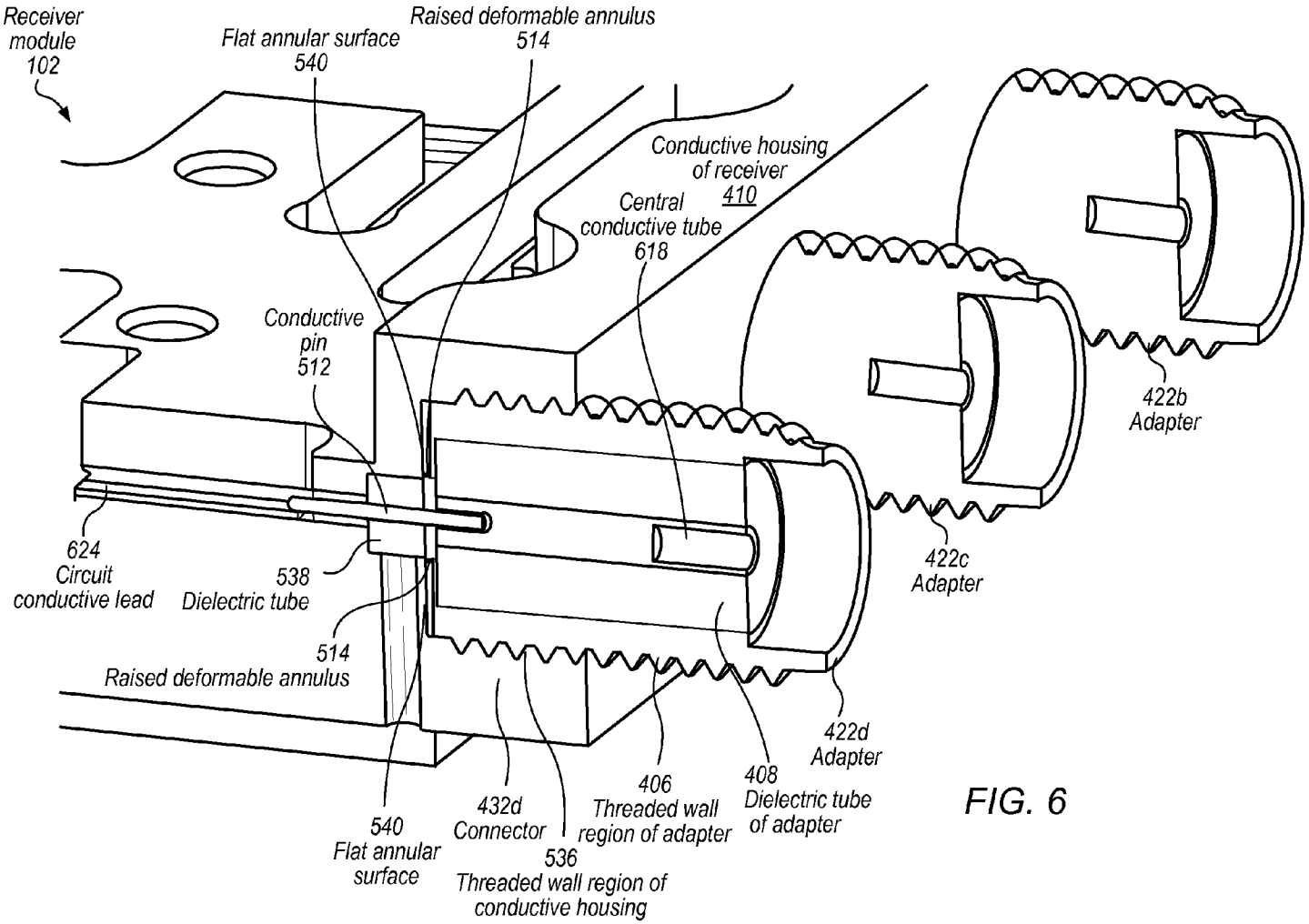
FIG. 6 illustrates a cutaway view of a receiver module including a connector according to one embodiment of the present invention.

FIG. 6 illustrates a cutaway view of a receiver module including a connector according to one embodiment of the present invention. A device having a number of ports (connectors) designed for coupling to complementary RF connectors (e.g., thread-in connectors or adapters of SMA type) is shown in FIG. 6. Conductive housing of receiver 410 is shown with adapters 422*b-d*. Each of adapters 422*b-d* is shown cut open along a vertical plane that passes through the central axis of the respective one of adapters 422*b-d*. Each of adapters 422*b-d* screws into a respective port, such as adapter 422*d* at connector 432*d*. Conductive pin 512 is inserted through a central hole of flat annular surface to electrically connect a central conductive tube 618 of adapter 422*d* to a circuit conductive lead 624. In some embodiments, central conductive tube 618 is continuous along the entire length of dielectric tube of adapter 408. Dielectric tube of adapter 408 electrically and physically isolates central conductive tube 618 from threaded wall region of adapter 406, such that threaded wall region of a adapter 406 can be used to conduct a first signal component (such as a ground) to conductive housing of receiver 410 and central conductive tube 618 can be used to conduct or transmit a second signal to central pin 512. Threaded wall region of adapter 406 affixes adapter 422*d* to connector 432*d*. Central conductive tube 618 is exposed at each end of dielectric tube 408 to facilitate connection with conductive pin 512 and another pin (not shown) at the opposite end of adapter 422*d*.

Figure 7:
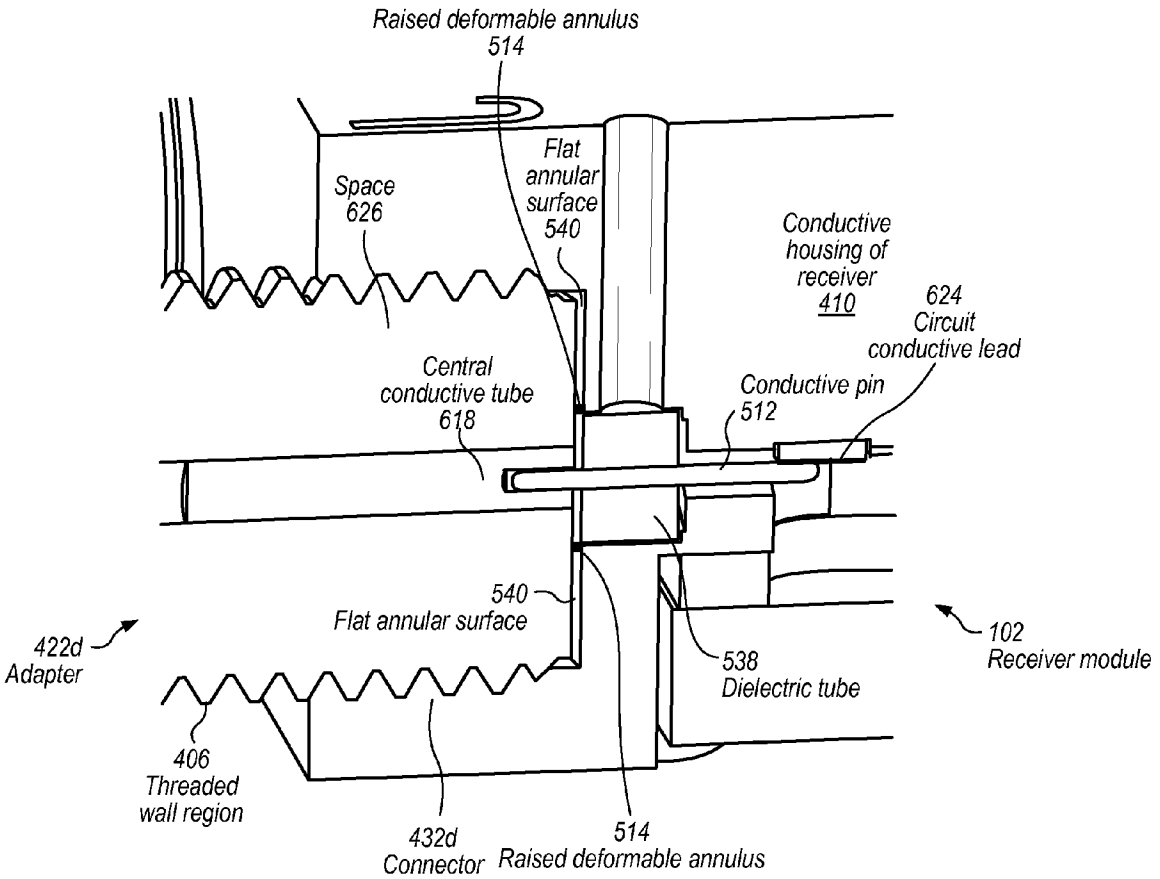
FIG. 7 depicts a cutaway view of a receiver module including a connector according to one embodiment of the present invention.

FIG. 7 depicts a cutaway view of a receiver module including a connector according to one embodiment of the present invention. Conductive housing of receiver 410 is shown is shown with adapter 422*d* affixed in connector 432*d*. Conductive pin 512 is inserted into receiver housing 410 to electrically connect central conductive tube 618 of adapter 422*d* to a circuit conductive lead (not shown). In some embodiments, central conductive tube 618 is affixed to and radially surrounded by dielectric tube (not shown) such that central conductive tube 618 is exposed at both a first end and a second end to allow central conductive tube 618 to receive conductive pins at both ends of central conductive tube 618. Threaded wall region 406 affixes adapter 422*d* to connector 432*d*. Raised deformable annulus 514 is visible on flat annular surface 540.

Figure 8:
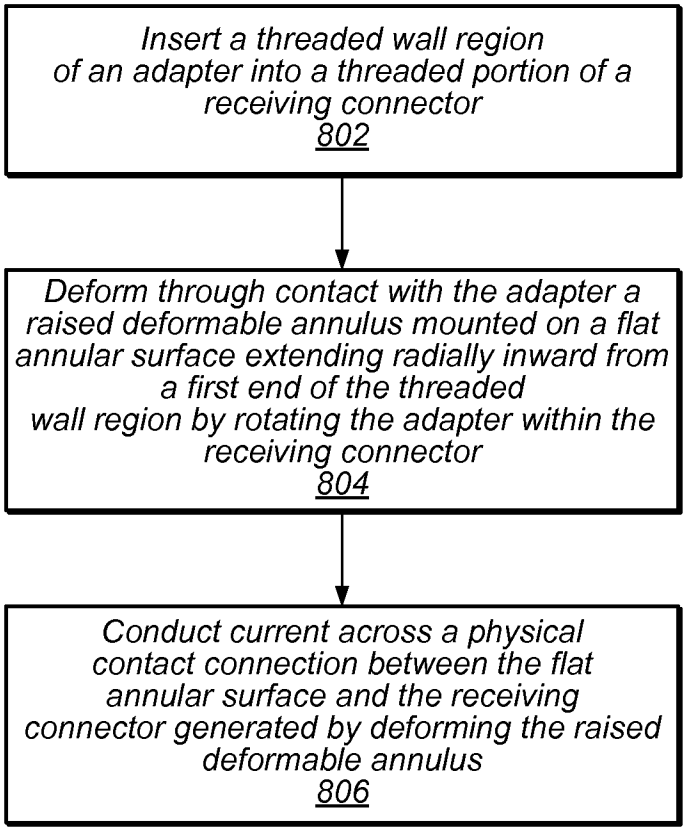
FIG. 8 is a flowchart of a method for using a connector according to one embodiment of the present invention.

FIG. 8 is a flowchart of a method for using a connector according to one embodiment of the present invention. A threaded wall region of an adapter is inserted into a threaded portion of a receiving connector (block 802). A raised deformable annulus mounted on a flat annular surface extending radially inward from a first end of the threaded wall region is deformed through contact with the adapter by rotating the adapter within the receiving connector (block 804). In some embodiments, the threaded wall region of the connector is designed such that a precisely measured and applied torque to the adapter will produce a calculated force on raised deformable annulus to deform the raised deformable annulus within expected specifications. In one embodiment, the raised deformable annulus is composed of a metal or a composite of metals and the contact interface is designed to undergo crushing when the adapter is screwed into the connector to yield a continuous contact surface area of a minimum expected size. Current is conducted across a physical contact connection between the flat annular surface and the receiving connector generated by deforming the raised deformable annulus (block 806).

Figure 9:
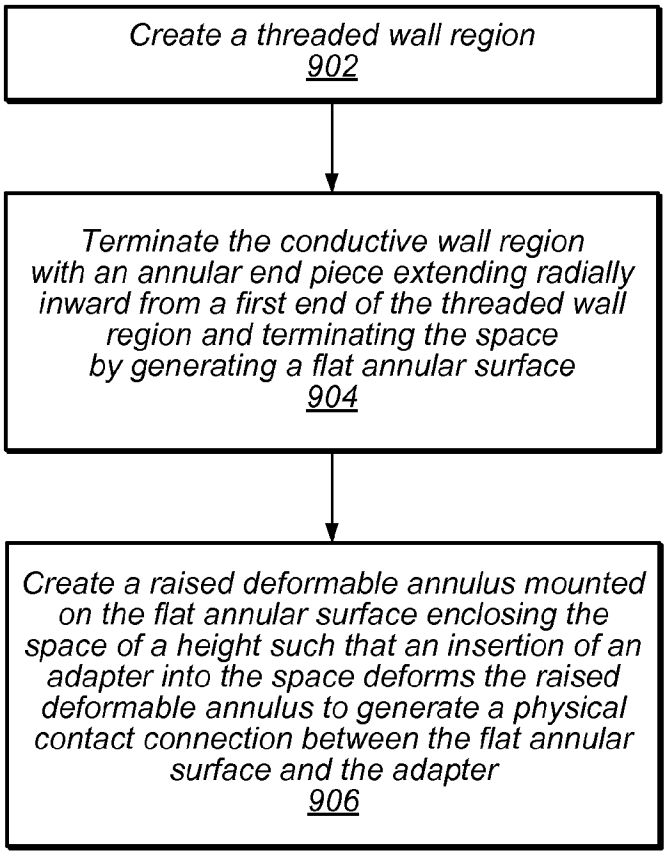
FIG. 9 is a flowchart of a method for fabricating a connector according to one embodiment of the present invention.

FIG. 9 is a flowchart of a method for fabricating a connector according to one embodiment of the present invention. A threaded wall region is created (block 902). The threaded wall region can be created by many methods, such as casting, molding, milling or press operations. The threaded (conductive) wall region is terminated with an annular end piece extending radially inward from a first end of the threaded wall region and terminating the space enclosed by the threaded wall region by generating a flat annular surface (block 904). Similarly, the flat annular surface may be generated by many methods, such as casting, molding, milling or press operations. A raised deformable annulus mounted on the flat annular surface of a height such that an insertion of an adapter into the connector deforms the raised deformable annulus to generate a physical contact connection between the flat annular surface and the adapter is created (block 906). The circular ring of the deformable annulus is made of a conductive material such as metal (or a composite of metals) and is created through machining, molding, plating or other forms of deposition at or near the inner radius of the annular ring. In one embodiment, the inner radius of the circular ring is the same as the inner radius of the annular ring.

Although the embodiments above have been described in considerable detail, numerous variations and modifications will become apparent to those skilled in the art once the above disclosure is fully appreciated. It is intended that the following claims be interpreted to embrace all such variations and modifications. Specifically, while the description above focuses on an example that uses SMA-type connectors, the principles described herein apply to any of a wide variety of connector types and one skilled in the art will realize, in light of having read the present disclosure, that such connectors fall within the scope and intent of the present disclosure. While the connector described herein is described as an electrical connector, one of skill in the relevant art will realize that connectors applying the principles described herein will find use in a wide range of applications ranging from electric current flow to fluid and gas flow or the maintenance of seals. The methods and techniques described herein may prove advantageous in any context in which a continuous coupling is desired to improve the effectiveness of a connection.

Furthermore, the principles described herein are not limited to RF connectors. For example, certain embodiments within the scope of the present disclosure may be used for establishing low contact resistance to any connector. In some embodiments, the techniques disclosed herein may be used to establish connection to ground or to a power supply in applications in a wide range of voltage and current scenarios. Likewise, in some embodiments, the crushable contact interface can be designed to provide a gas tight interface by choosing interface metals such as gold to form a 360-degree contact cold weld. Further, while the disclosure above focuses on an example of threaded connectors, it should be noted that the techniques and methods described herein apply broadly to connectors having any of a wide variety of coupling mechanisms. For example, the techniques and methods described herein may be used with bolt-in connectors as well. While the description included herewith focuses on the example of a connection established between a port of a device and a thread-in connector, one of skill in the art will understand, in light of having read the present disclosure, that the techniques and methods disclosed herein apply to any of a wide variety of connection scenarios. For example, the techniques and methods disclosed herein may be used to establish a connection between the thread-in connector and the end connector of a cable, or, to establish a connection between the end connectors of two cables.

We claim:

1. A method for fabricating a connector, comprising;

creating a housing comprising a wall region enclosing a space for receiving an adapter;

terminating the wall region with an annular end piece extending radially inward from a first end of the wall region and terminating the space; and creating a raised deformable annulus mounted on a flat annular surface of the annular end piece of a height such that an insertion into the housing of the adapter deforms the raised deformable annulus to generate a physical contact connection between the flat annular surface and the adapter, wherein the raised deformable annulus comprises a conductive material.

2. The method of claim 1, wherein creating the raised deformable annulus further comprises depositing the conductive material on the flat annular surface.

3. The method of claim 1, wherein creating the raised deformable annulus further comprises shaping the annular end piece.

4. The method of claim 1, further comprising inserting a dielectric tube into the housing.

5. The method of claim 4, further comprising inserting a center conductive pin within the housing such that the center conductive pin is radially surrounded by the dielectric tube over a portion of a length of the center conductive pin.

6. The method of claim 1, further comprising threading the wall region with threads such that a torque used to completely insert the adapter into the connector generates a pressure on the raised deformable annulus greater than a yield strength of a material of the raised deformable annulus.

7. The method of claim 1, wherein creating a raised deformable annulus mounted on a flat annular surface of the annular end piece further comprises creating a raised deformable annulus mounted on a flat annular surface of the annular end piece of a height such that an insertion into the housing of the adapter deforms the raised deformable annulus to generate a 360-degree physical contact connection between the flat annular surface and the adapter.

8. The method of claim 1, wherein creating a raised deformable annulus mounted on a flat annular surface of the annular end piece further comprises creating a raised deformable annulus mounted on a flat annular surface of the annular end piece of a height such that an insertion into the housing of the adapter deforms the raised deformable annulus to generate a gas-tight physical contact connection between the flat annular surface and the adapter.

* * * * *